US011608977B1

(12) United States Patent
Cascia et al.

(10) Patent No.: US 11,608,977 B1
(45) Date of Patent: Mar. 21, 2023

(54) BATHTUB OVERFLOW COVER LIGHTING DEVICE

(71) Applicants: Phil Cascia, Oklahoma City, OK (US); Adele Fischman, Oklahoma City, OK (US); Nathan Moran, Oklahoma City, OK (US)

(72) Inventors: Phil Cascia, Oklahoma City, OK (US); Adele Fischman, Oklahoma City, OK (US); Nathan Moran, Oklahoma City, OK (US)

(73) Assignee: Jasco Products Company, LLC, Oklahoma City, OK (US)

( * ) Notice: Subject to any disclaimer, the term of this patent is extended or adjusted under 35 U.S.C. 154(b) by 0 days.

(21) Appl. No.: 17/551,259

(22) Filed: Dec. 15, 2021

(51) Int. Cl.

| | |
|---|---|
| ***F21V 33/00*** | (2006.01) |
| ***A47K 3/00*** | (2006.01) |
| ***E03C 1/24*** | (2006.01) |
| ***F21V 23/04*** | (2006.01) |
| ***F21V 31/00*** | (2006.01) |
| ***F21Y 113/10*** | (2016.01) |
| ***F21Y 115/10*** | (2016.01) |

(52) U.S. Cl.
CPC ..... *F21V 33/004* (2013.01); *A47K 3/001* (2013.01); *E03C 1/24* (2013.01); *F21V 23/0435* (2013.01); *F21V 31/005* (2013.01); *F21Y 2113/10* (2016.08); *F21Y 2115/10* (2016.08)

(58) Field of Classification Search
CPC .. F21V 33/004; F21V 23/0435; F21V 31/005; A47K 3/001; E03C 1/24
See application file for complete search history.

(56) References Cited

U.S. PATENT DOCUMENTS

| | | | | |
|---|---|---|---|---|
| 4,535,489 | A * | 8/1985 | Elkins | F21V 33/004 4/584 |
| 6,877,171 | B2 * | 4/2005 | Shimizu | F21V 33/004 4/541.1 |
| 6,886,958 | B1 * | 5/2005 | Grant | F21V 33/004 362/555 |
| 7,008,073 | B2 * | 3/2006 | Stuhlmacher, II | E03C 1/0404 362/253 |
| 8,438,672 | B2 * | 5/2013 | Reeder | E03D 9/04 4/668 |
| 10,222,053 | B2 * | 3/2019 | Brunelle | A61H 33/00 |
| 10,670,801 | B2 * | 6/2020 | Mooren | F21S 9/02 |
| 2009/0125085 | A1 * | 5/2009 | Salgarelli | A61M 21/00 600/26 |
| 2021/0395985 | A1 * | 12/2021 | Hsu | E03C 1/24 |

* cited by examiner

*Primary Examiner* — Arman B Fallahkhair
(74) *Attorney, Agent, or Firm* — William D. Popejoy

(57) ABSTRACT

The present invention provides a visual experience in the bathtub setting. A bathtub overflow cover, which may be removably affixed to an inner wall of a bathtub, with a dedicated portion of a housing to secure a lighting device below a bathtub waterline, is described herein. The lighting device illuminates bathtub water and produces a bathtub glow. Embodiments described for the present invention comprise a bathtub overflow valve cover, a power source, a housing, which attaches to an inner wall of a bathtub, where the housing provides a watertight seal around a bathtub overflow valve preventing water from escaping a bathtub overflow port, and one or more LED lights. The embodiment may further comprise one or more RGB LED lights with color changing capability. Embodiments may further comprise one or more pushbuttons to adjust one or more integrated features.

19 Claims, 3 Drawing Sheets

BATHTUB OVERFLOW COVER LIGHTING DEVICE

BACKGROUND OF THE INVENTION

1. Field of the Invention

The present invention pertains to bathtub water level control devices, particularly overflow valve covers that provide a user the ability to maintain a consistently higher bathtub water level.

2. Description of the Related Art

The benefits of bathing are well documented, which include: mood elevation, sleep improvement, cardiovascular benefits, breathing help, muscle pain relief, calorie expenditure, immunity benefits, cold and flu symptom relief, irritated skin relief, brain and nervous symptom benefits, and hormone balance.

Bathtub users often enjoy and prefer the benefits of a deeper bath. A higher water level within the bathtub area potentially may allow the submersion of more of a bathtub user's body.

Overflow covers are known and used in a bathtub context and application. The devices may prevent or slow down the departure of water from within a bathtub. Bathtub overflow covers generally provide a bathtub user the ability to maintain a water level above the height of a bathtub overflow port.

The benefits of overflow covers in the bathtub setting are well documented. Maintaining a higher water level within a bathtub provides a user health and relaxation benefits of a bath while in a more upright position.

The following related prior arts have been discovered:

U.S. Pat. No. 7,856,677 discloses a cover for a bathtub overflow port and an associated method. This device contains a cover for a bathtub overflow port which includes a concave body provided with a circular inner edge maintaining a vacuum seal with an inner surface of the existing bathtub. The circular inner edge of the body is removably abutted directly against the inner surface of the existing bathtub during operating conditions.

U.S. Pat. No. 6,216,288 discloses a sealing member for a bathtub. A conventional plate is coupled to the wall of a bathtub and covers a drain opening formed therein. The plate is continuous except for an overflow opening which accommodates the free flow of water from the bathtub through the drain opening and down the overflow drain of the bathtub. The sealing member engages the plate and the bathtub wall to prevent water from flowing through the overflow opening of the plate and down the overflow drain of the bathtub. The sealing member includes an annular lip which fits snugly within the overflow opening a the plate. In an alternate embodiment, a bypass opening is formed in the sealing member at a height greater than that of the overflow opening of the plate. A channel formed within the sealing member extends between the bypass opening and the overflow drain. Water may then enter the sealing member at a height greater than the overflow opening and be channeled through the overflow drain and out of the bathtub.

U.S. Pat. No. 5,330,811 discloses a laminate cover member for upgrading the appearance of a deteriorated drain hole or other surface of a sink or bath fixture. The cover member includes an upper layer which is resistant to corrosion and has an attractive visual appearance, a pressure sensitive adhesive layer, and a removable liner layer. The layers are die-cut from stock laminate sheets. A preferred cover member, for upgrading the surfaces of a drain hole, has a metallized plastic upper layer, and is shaped with an outer annular portion that is adhered to the surface surrounding the drain hole, an inner annular hole, and a plurality of radial lines extending from an intermediate diameter to the inner annular hole, such that they can be bent downwardly to cover an inner part of the drain hole surface.

U.S. Pat. No. 5,025,509 to Holt discloses an overflow level controller for a bathtub. The overflow level controller includes an adapter ring to facilitate connection with a conventional bathtub fixture base, and further includes housing with a removable covering. Rotation of the housing adjusts the overflow level of the bathtub. Unfortunately, this prior art example is not designed to completely prevent the draining of water from a bathtub via the overflow port.

The discovered prior art helps prevent unwanted water departure from a bathtub area, However, the discovered prior art does not seek to create a visual experience that increases the relaxation benefits of the bath experience.

SUMMARY OF THE INVENTION

The present invention provides a visual experience in the bathtub setting. A bathtub overflow cover which may be removably affixed to an inner wall of a bathtub, with a dedicated portion of a housing to secure a lighting device below a bathtub waterline is described herein. The lighting device illuminates bathtub water and produces a bathtub glow.

Embodiments described for the present invention comprise a bathtub overflow valve cover, a power source, a housing, which attaches to a conventional bathtub, where the housing completely covers a bathtub overflow valve preventing water from escaping a bathtub overflow port, one or more LED lights, where the one or more LED lights illuminate bathtub water and create a bathtub glow. The embodiment may further comprise one or more RGB LED lights with color changing capability.

In another embodiment of the invention, the bathtub overflow valve cover further comprises one or more pushbuttons, where: the one or more pushbuttons may turn the device on and off, the one or more pushbuttons may change the functionality of the device, and the one or more pushbuttons may change the color or intensity of the one or more LED lights.

In some embodiments, the bathtub overflow valve cover may further comprise a remote control, a variety of bathtub wall attachment methods, wireless control, app control, a variety of functionality controls, color intensity control, and lighting scene compatibility.

In some embodiments, the bathtub overflow valve cover may further comprise the following functionalities: clock, alarm, music, thermometer, motion detect, or other.

It should be appreciated that combinations of the foregoing concepts and additional concepts discussed in greater detail below are contemplated as being part of the inventive subject matter disclosed herein. In particular, all combinations of claimed subject matter appearing at the end of this disclosure, or elsewhere herein, are contemplated as being part of the inventive subject matter.

These and other systems, methods, objects, features, and advantages of the present invention will be apparent to those skilled in the art from the following detailed description of the preferred embodiment and the drawings.

BRIEF DESCRIPTION OF THE DRAWINGS

One or more embodiments are illustrated by way of example, and not by limitation, reference will now be made to the accompanying drawings, having the same numeral designations to represent like elements throughout and wherein.

Figure 1:
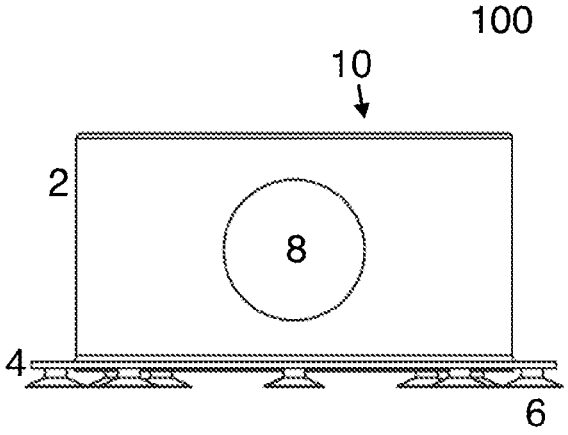
FIG. 1 is an exploded view of an embodiment of the current invention.

While the invention has been described in connection with certain preferred embodiments, other embodiments would be understood by one of ordinary skill in the art and are encompassed herein.

ELEMENTS WITH CORRESPONDING REFERENCE NUMERALS

| | |
|---|---|
| Bathtub Overflow Cover Lighting Device | 100 |
| Housing | 2 |
| Housing Sealing Edge | 4 |
| Housing Suction Cups | 6 |
| Housing Overflow Prevention Hole | 8 |
| Front Face of the Housing | 10 |
| Power Source and Lighting Housing | 12 |
| Power Source and Lighting Housing End | 14 |
| RGB LED Lights | 16 |
| Battery Power Source | 18 |

DETAIL DESCRIPTION OF THE INVENTION

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. Well-known structures and devices are shown in order to facilitate describing the subject innovation. Moreover, it is to be appreciated that the drawings may not be to scale.

FIG. 1 is an exploded view of an embodiment of a bathtub overflow cover lighting device 100. The bathtub overflow cover lighting device 100 may include a variety of additional components. The bathtub overflow cover lighting device 100 may be used to cover most standard sized bathtub overflow ports. The device utilizes housing suction cups 6 located on a housing sealing edge 4 to affix a housing 2 to a wall of a bathtub. The housing 2 is removably affixed to an inner wall of a bathtub.

The bathtub overflow cover lighting device housing 2 may be constructed in a general horizontal cylindrical shape with a rectangular cuboid extension in the bottom of the housing. The horizontal cylindrical shape is correctly sized to completely cover a standard sized bathtub overflow port.

The housing suction cups 6 in combination with the housing sealing edge 4 create a removable seal of the housing 2 to the inner wall of a bathtub which prevents the unwanted departure of water through a bathtub overflow port from within a bathtub area. Further, the seal allows a user to maintain an increased depth of water within the bathtub.

The housing overflow prevention hole 8 provides a bathtub user a safety mechanism to prevent water from escaping over the edges of a bathtub area. The housing overflow prevention hole may be of varying diameters and locations within the bathtub overflow cover lighting device housing 2. Once the housing 2 is affixed to an inner wall of a bathtub, embodiments of the present invention place the hole at the top of the housing 2. The housing overflow prevention hole 8 may be circular, rectangular, square, geometric or irregular in shape.

The housing overflow prevention hole 8 provides an entry point for water to enter the housing 2 once the water reaches a certain depth within a bathtub area. After entering the housing, the water will then be able to exit a bathtub overflow port.

The rectangular cuboid extension provides an area to insert and hold a power and lighting device housing 12 within the bathtub overflow cover housing 2. In embodiments of the present invention, a battery power source (not shown) 18 and LED lights (not shown) 16 may be included in the power and lighting device housing 12.

The present invention is not limited by a rectangular cuboid extension area within the bathtub overflow lighting device housing 2. The power and lighting device housing 12 and the extension below the horizontal cylindrical shape may be of a variety of possible shapes and sizes. Further, the present invention is not limited by a horizontal cylindrical shape within the housing 2. Any possible shape which completely covers a bathtub overflow port and allows for the device 100 to be affixed to an inner wall of a bathtub is within the present disclosure.

The power and lighting device housing 12 may be held by the bathtub overflow cover housing 2 below the waterline of a bathtub. The LED lights illuminate the water and create a bathtub water glow. The embodiment may further comprise one or more RGB LED lights with color changing capability.

In another embodiment of the invention, the bathtub overflow valve cover further comprises one or more pushbuttons, where: the one or more pushbuttons may turn the device on and off, the one or more pushbuttons may change the functionality of the device, and the one or more pushbuttons may change the color or intensity of the one or more LED lights.

The one or more pushbuttons may be at different locations on the device, and the one or more pushbuttons may use any available technology obvious to one having skill in the art. The one or more pushbuttons may control the device only or control a multiple device lighting scene in the bathroom.

In some embodiments, the bathtub overflow cover lighting device 100 may further comprise a remote control. The remote control may control the light intensity, provide color changing capability control to RGB LED lights, control a multiple device lighting scene, turn on or off the device, and/or control additional functionalities of the device.

In some embodiments, the bathtub overflow cover lighting device may further comprise additional functionalities, including but not limited to: clock, alarm, music response, music playing, thermometer, and motion detect. The bathtub glow created by the RGB LED lights of the bathtub overflow cover lighting device may change in color and/or intensity in response to the additional functionalities.

Figure 2:
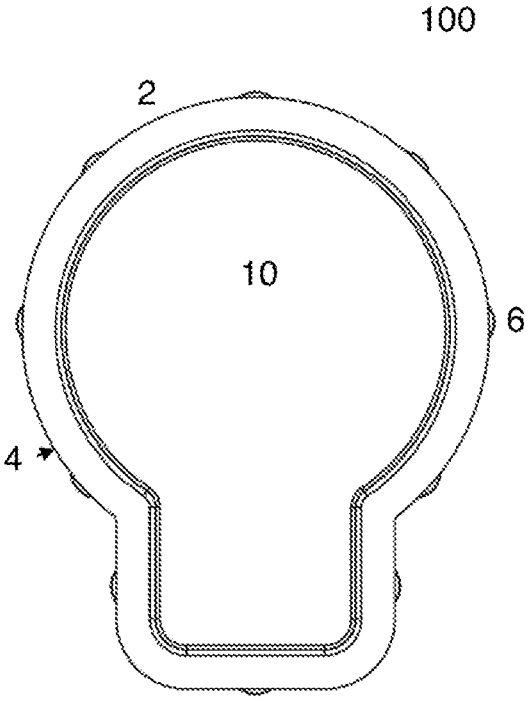
FIG. 2 is a front elevational view of an embodiment of the current invention.

FIG. 2 is a front elevational view of an embodiment of a bathtub overflow cover lighting device 100. The front face of the housing 10 is orientated towards a bathtub user once the device 100 is removably affixed to an inner wall of a bathtub. The housing 2 is affixed to the bathtub wall by the housing suction cups 6 and the housing sealing edge 4.

Figure 3:
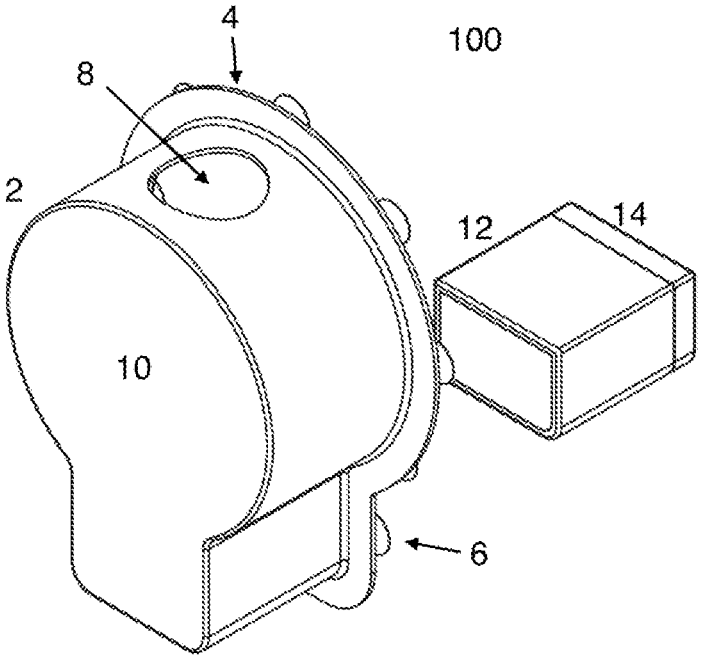
FIG. 3 is a top elevational view of an embodiment of the current invention.

FIG. 3 is a top elevational view of an embodiment of a bathtub overflow cover lighting device 100. The housing suction cups 6 help create a watertight seal around the bathtub overflow cover housing 2. The housing overflow prevention hole 8 allows water to enter the housing 2 and exit a bathtub overflow port (not shown) once water in a bathtub area reaches a certain depth.

A variety of inner bathtub wall attachment methods are conceived within the present invention.

FIG. 3 illustrates housing suction cups 6 and a housing sealing edge 4. However, any attachment method obvious to one having skill in the art is disclosed in the present invention.

Figure 4:
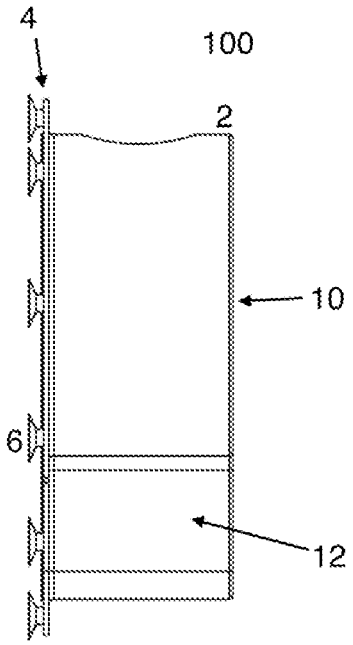
FIG. 4 is a right elevational view of an embodiment of the current invention.
Figure 5:
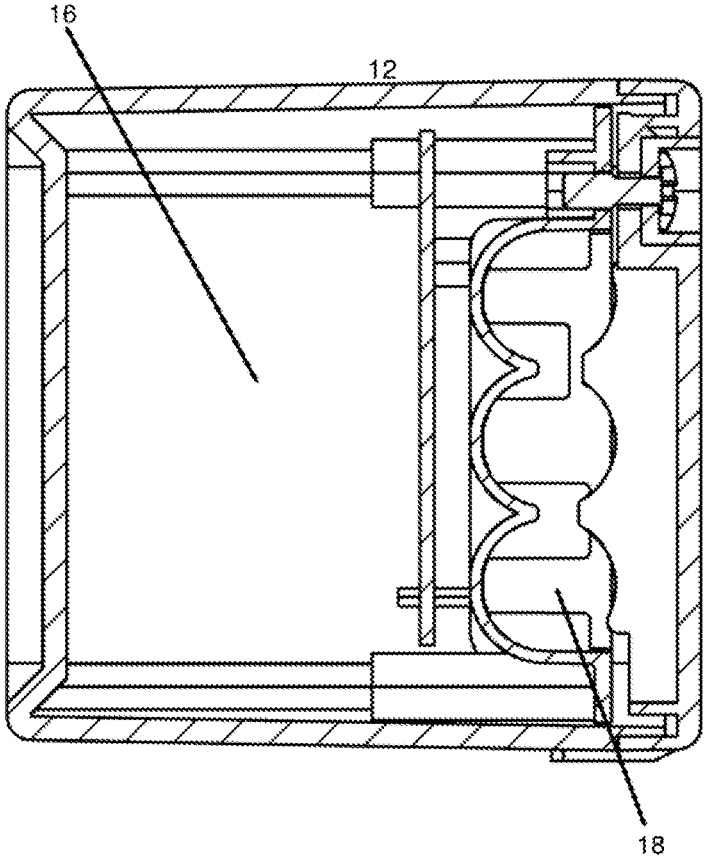
FIG. 5 is a section view of the power source and lighting housing.

FIG. 4 is a right elevational view of an embodiment of a bathtub overflow cover lighting device 100. The power source and lighting housing 12 may be located within the rectangular cuboid extension of the lower portion of the bathtub overflow cover lighting device housing 2. The LEDs (not shown) within the power source and lighting housing 12 may be below the waterline of a bathtub. The illumination of the LED lights create a bathtub glow.

Although the present invention has been described in relation to particular embodiments thereof, many other variations and modifications will become apparent to those skilled in the art. It is preferred, therefore, that the present invention be limited not by the specific disclosure herein, but only by the appended claims. Alternative embodiments may be devised without departing from the spirit or scope of the invention. Further, the particular feature or structure may be combined in any suitable manner in one or more embodiments.

What is claimed is:

1. A bathtub overflow valve cover device comprising: a power source; a housing adapted to fit predominantly on a conventional bathtub overflow valve to removably affix to an inner wall of a bathtub; the housing creates a water-tight seal around the conventional bathtub overflow valve preventing water from escaping a bathtub overflow port; one or more LED lights; the one or more LED lights configured to illuminate water in the bathtub and produce a bathtub glow; and a housing overflow prevention hole on top of the housing configured to allow for the conventional bathtub overflow valve to continue to function while the one or more LED lights are submerged below a waterline and produce the bathtub glow; wherein an extension of a lower portion of the housing accommodates the power source and a lighting housing for the one or more LED lights within the housing.

2. The bathtub overflow valve cover device of claim 1, further comprising:

the one or more LED lights are RGB LED lights; and the one or more LED lights configured to have color changing capability.

3. The bathtub overflow valve cover device of claim 1, further comprising:

one or more pushbuttons;

the one or more pushbuttons configured to turn the device on or off;

the one or more pushbuttons configured to adjust integrated features of the device;

the integrated features configured to include, but are not limited by the following: clock, music, thermometer, motion detect, or other; and the one or more pushbuttons configured to change the color or intensity of the one or more LED lights.

4. The bathtub overflow valve cover device of claim 1, further comprising:

a remote control;

the remote control configured to turn the device on or off;

the remote control configured to change integrated features of the device;

the integrated features configured to include, but are not limited by the following: clock, music, thermometer, motion detect, or other; and the remote control configured to change the color or intensity of the one or more LED lights.

5. The bathtub overflow valve cover device of claim 1, further comprising: housing suction cups, and the housing configured to attach to the inner wall of the bathtub.

6. The bathtub overflow valve cover device of claim 1, further comprising:

the bathtub overflow valve cover device configured to be controlled wirelessly through a wireless controlled application on a phone or mobile device; and the bathtub overflow valve cover device configured to be controlled as a part of a lighting scene with other lighting products on the wireless controlled application.

7. The bathtub overflow valve cover device of claim 1, further comprising:

the bathtub overflow valve cover device configured to be controlled to adjust the intensity of the one or more LED lights.

8. The bathtub overflow valve cover device of claim 1, further comprising:

the bathtub overflow valve cover device configured to be controlled to produce different lighting colors and/or intensities based on a response to music or sound.

9. The bathtub overflow valve cover device of claim 1, further comprising:

one or more of the following integrated features: clock, music, thermometer, motion detect, or other.

10. The bathtub overflow valve cover device of claim 1, further comprising: the extension of the lower portion of the housing accommodates the one or more LED lights below a waterline of the bathtub; and the one or more LED lights produce the bathtub glow.

11. A bathtub overflow valve cover device comprising: a power source; a housing adapted to fit predominantly on a conventional bathtub overflow valve to removably affix to an inner wall of a bathtub; the housing creates a watertight seal around a the conventional bathtub overflow valve preventing water from escaping a bathtub overflow port; one or more LED lights; the one or more LED lights configured to illuminate water in the bathtub and produce a bathtub glow; an extension of a lower portion of the housing of the bathtub overflow valve cover; the extension of a lower portion of the housing of the bathtub overflow valve cover accommodates the one or more LED lights within the housing; the extension of a lower portion of the housing of the bathtub overflow valve cover configured to accommodate the power source and a lighting housing; and a housing overflow prevention hole on top of the housing configured to allow for the conventional bathtub overflow valve to continue to function while the one or more LED lights are submerged below a waterline of the bathtub and are producing the bathtub glow.

12. The bathtub overflow valve cover device of claim 11, further comprising:

the housing is predominantly cylindrical;

a housing sealing edge; and the housing is clear or translucent.

13. The bathtub overflow valve cover device of claim 11, further comprising:

the bathtub overflow valve cover device configured to be controlled wirelessly through a wireless controlled application on a phone or mobile device; and the bathtub overflow valve cover device configured to be controlled as a part of a lighting scene with other lighting products on the wireless controlled application.

14. The bathtub overflow valve cover device of claim 11, further comprising:

the bathtub overflow valve cover device configured to be controlled to adjust the intensity of the one or more LED lights.

15. The bathtub overflow valve cover device of claim 11, further comprising:

the bathtub overflow valve cover device configured to be controlled to produce different lighting colors and/or intensities based on a response to music or sound.

16. The bathtub overflow valve cover device of claim 11, further comprising:

one or more of the following integrated features: clock, music, thermometer, motion detect, or other.

17. The bathtub overflow valve cover device of claim 11, further comprising:

one or more pushbuttons;

the one or more pushbuttons configured to turn the device on or off;

the one or more pushbuttons configured to adjust integrated features of the device;

the integrated features configured to include, but are not limited by the following: clock, music, thermometer, motion detect, or other; and the one or more pushbuttons configured to change the color or intensity of the one or more LED lights.

18. The bathtub overflow valve cover device of claim 11, further comprising:

the extension of a lower portion of the housing of the bathtub overflow drain cover is a rectangular cuboid extension.

19. A bathtub overflow valve cover device comprising a power source; a predominantly cylindrical housing adapted to fit predominantly on and affix over a conventional bathtub overflow valve; an extension of a lower portion of the housing of the bathtub overflow valve cover accommodates the power source and a lighting housing, the lighting housing including one or more LED lights to illuminate water in a bathtub and produce a bathtub glow; and a housing overflow prevention hole on top of the housing configured to allow for the conventional bathtub overflow valve to continue to function while the one or more LED lights are submerged below a waterline of the bathtub and are producing the bathtub glow.

* * * * *